US005765473A

United States Patent [19]

Gummelt

[11] Patent Number: 5,765,473

[45] Date of Patent: Jun. 16, 1998

[54] FOOT OPERATED CAN CRUSHER

[76] Inventor: Tommy L. Gummelt, P.O. Box 5331, Amarillo, Tex. 79117

[21] Appl. No.: 834,618

[22] Filed: Apr. 14, 1997

[51] Int. Cl.[6] ..... B30B 9/32

[52] U.S. Cl. ..... 100/266; 100/281; 100/902

[58] Field of Search ..... 100/35, 231, 266, 100/280, 281, 283, 293, 902

[56] References Cited

U.S. PATENT DOCUMENTS

| | | | |
|---|---|---|---|
| D. 324,390 | 3/1992 | Byers . | |
| 1,420,325 | 6/1922 | Little | 100/281 |
| 2,178,461 | 10/1939 | Apprill | 100/902 |
| 3,009,414 | 11/1961 | Griemert | 100/902 |
| 3,388,422 | 6/1968 | Benoit | 100/266 |
| 4,188,875 | 2/1980 | Fabbri et al. . | |
| 4,208,961 | 6/1980 | Okajima | 100/902 |
| 4,292,891 | 10/1981 | Shelley . | |
| 4,417,512 | 11/1983 | Engelke . | |
| 5,009,155 | 4/1991 | Christainson . | |
| 5,033,375 | 7/1991 | Reeves . | |

*Primary Examiner*—Stephen F. Gerrity
*Attorney, Agent, or Firm*—Wendell Coffee

[57] ABSTRACT

A foot operated device for crushing beverage cans.

3 Claims, 3 Drawing Sheets

FOOT OPERATED CAN CRUSHER

BACKGROUND OF THE INVENTION (1) Field of the Invention

This invention relates to crushing empty beverage cans. Welders and millwrights have ordinary skill in this art.

(2) Description of the Related Art

Many devices describe methods of crushing cans. Most of these devices use levers to gain mechanical advantage and are powered by the strength of the human arm. Others use the weight of body as the crushing force.

Those devices that use the strength of the human arm as the power to crush the cans always use a lever to gain mechanical advantage. See Shelley U.S. Pat. No. 4,292,891. This is especially true of those devices that crush the can along its longitudinal axis. See Christianson U.S. Pat. No. 5,009,155; Fabbfi et al. U.S. Pat. No. 4,188,875; Byers U.S. Pat. No. Des. 324,390.

Those devices that use the weight of an operator, or at least the greater strength of the leg as compared to an arm, to crush the can do not attempt to gain any mechanical advantage. Indeed, those devices that do not use levers generally rely on the strength of the leg, mass of the operator and the acceleration due to gravity, along with any kinetic energy, to effectuate the force to crush the can. See Flick U.S. Pat. No. 3,988,978; Engelke U.S. Pat. No. 4,417,512; Reeves U.S. Pat. No. 5,033,375.

SUMMARY OF THE INVENTION (1) Progressive Contribution to the Art

The device I have invented merges the advantages and benefits of the systems described above. Namely, mechanical advantage in combination with the greater strength of the leg and mass of the operator.

Like many can crushers, the can itself is crushed longitudinally between a stationary anvil piece and a movable ram. The mechanism moving the ram is a tension member, connected to a foot pedal, in such a way as to gain a mechanical advantage. Pressing on the foot pedal with the strength of an operator's leg, as well as any kinetic energy imparted by the operator by having motion of the body before contact with pedal, and the act of moving the operators center of gravity over the pedal by standing above it, imparts a force to the pedal. The force imparted to the pedal then, by mechanical advantage of lever, tensions a tension member thereby moving the ram piece to crush the can against the anvil. This combination of mechanical advantage and using the stronger muscles of one leg makes crushing the can significantly easier than those devices that rely on strength of the arm.

An additional feature, not found in most of the devices that rely on the leg operation or the operators weight, is that the beverage can is placed and removed at an elevation in relation to the operator that does not require the operator to stoop to place an uncrushed can, or to remove a crushed can.

(2) Objects of this Invention

An object of this invention is to provide a can crushing device that may be either free standing or attached to a vertical support structure.

Another object is to provide a mechanism for crushing cans that is significantly easier to operate by virtue of using the leg strength and body weight, as opposed to arm strength alone, to crush beverage cans.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require skilled people to install, operate, and maintain.

The specific nature of the invention, as well as other objects, uses, and advantages thereof, will clearly appear from the following description and from the accompanying drawings, the different views of which are not necessarily scale drawings.

CATALOGUE OF ELEMENTS

Figure 1:
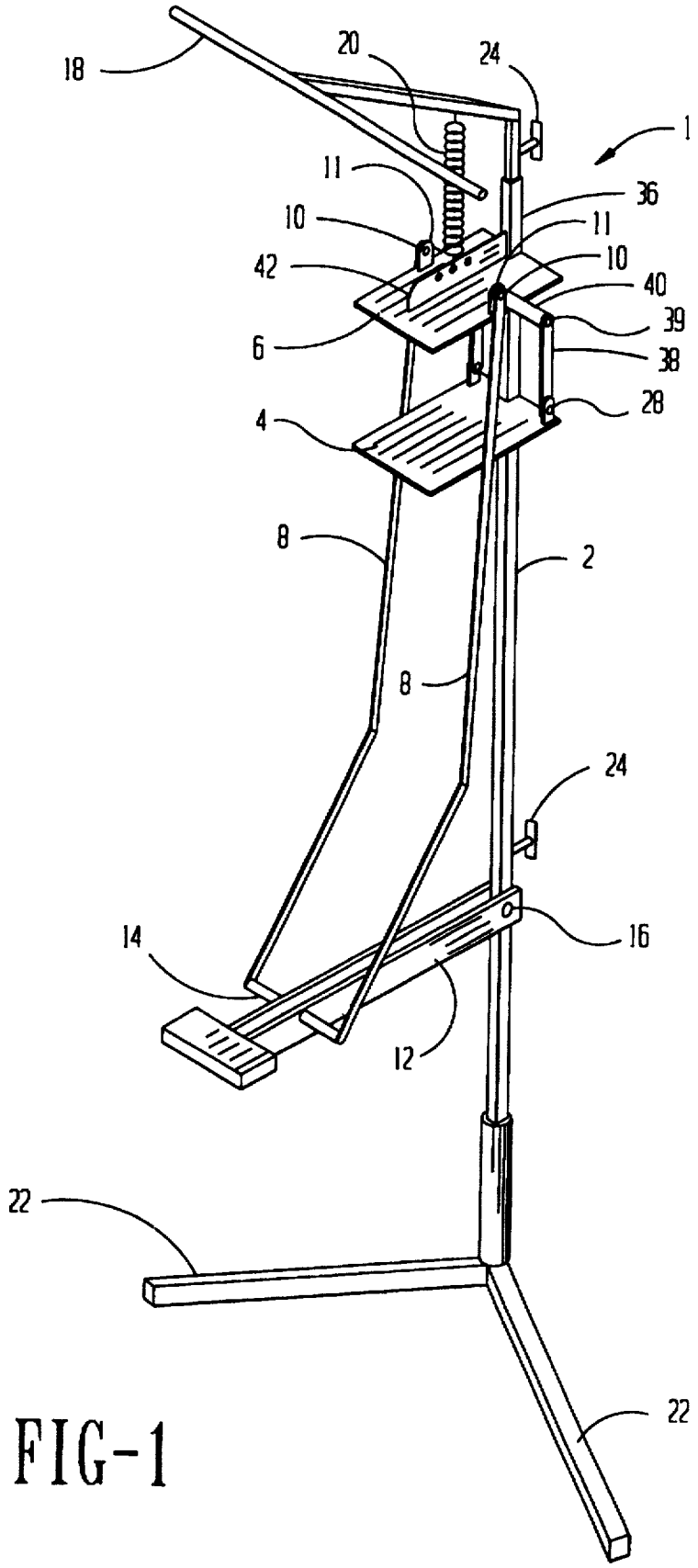
FIG. 1 is a perspective view of a can crusher embodying this invention.

As an aid to correlating the terms of the claims to the exemplary drawing(s), the following catalog of elements and steps is provided:

1 upper portion
2 spine
3 lower portion
4 anvil
6 ram
8 tension member
10 ram pivot
11 ear on ram
12 foot pedal
14 foot pedal pivot
16 foot pedal-spine pivot
18 handle
20 tensioned spring
22 legs
24 brackets
26 guides
28 anvil pivot connections
29 ear on anvil
32 operator
34 beverage can
36 square tube
38 link
39 pivot
40 link
42 spring connection

DESCRIPTION OF THE PREFERRED EMBODIMENTS(S)

As seen with the drawings, the main vertical element made of a square tube is a spine 2. Rigidly attached to spine 2 is a stationary crushing anvil 4. A movable ram 6 is positioned above the anvil 4. The ram 6 is attached to square tube 36 which is telescoped about the upper portion 1 of the spine 2 ("upper spine"). Movement of the ram 6 is allowed to move in the longitudinal parallel direction of spine 2. Beverage cans are crushed between the stationary anvil 4 and the ram 6 by movement of the ram 6 toward the anvil 4.

The ram 6 is moved by tension member 8. Tension member 8 is connected to a foot pedal 12 by foot pedal pivot 14. The foot pedal 12 connects to the lower portion of the spine 3 ("lower spine") by a foot pedal-spine pivot 16.

A handle 18 is connected at the top of upper spine 1. Said handle 18 extends in the frontal direction, i.e. the same direction as the anvil 4 and the ram 6.

The device further comprises a tension spring 20 connected at its lower end to the ram 6 by a spring connection 42 and at its upper end to a arm connecting the handle 18 to the spine 2.

At the lower spine 3, there are legs 22 extending perpendicular in relation to the spine 2. Said legs 22 forming a means for support of the device.

For further support of the device, brackets 24 are included. There may be any number of brackets 24 but at least one of such will be used. The brackets 24 connect directly and rigidly to the spine 2 for connection to a vertical support structure.

The can crusher also has a set of guides 26. The guides 26 consist of two links, 38 and 40, and a pivot 39 connecting same. The guides 26 interconnect the ram 6 to the anvil 4. The guides 26 connect at their respective ram pivot 10, connected to the ram at ears 11, and at the anvil pivot connections 28, connected to the anvil ears 29.

Figure 2:
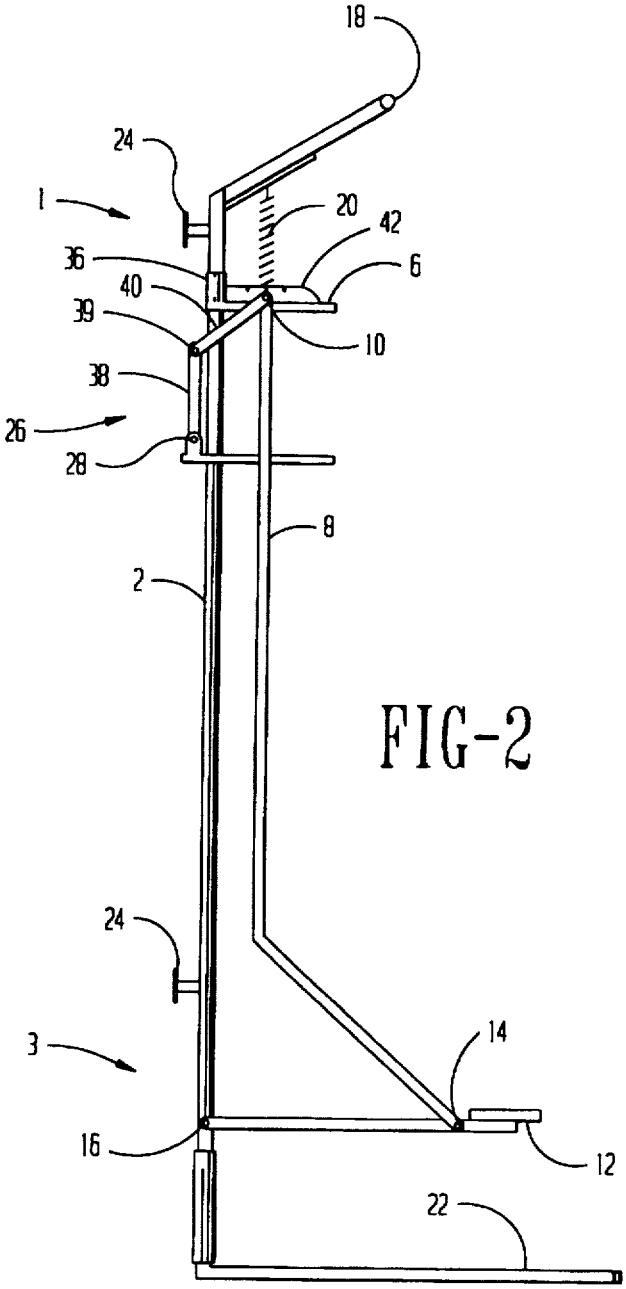
FIG. 2 is a side elevational view of the crusher.

FIG. 2 shows the orientation of the legs 22 to the spine 2. It further shows all pertinent elements, save the brackets 24, extend in a direction termed the frontal direction. E.g. the anvil 4, ram 6, foot pedal 12, handle 18, and legs 22.

Figure 3:
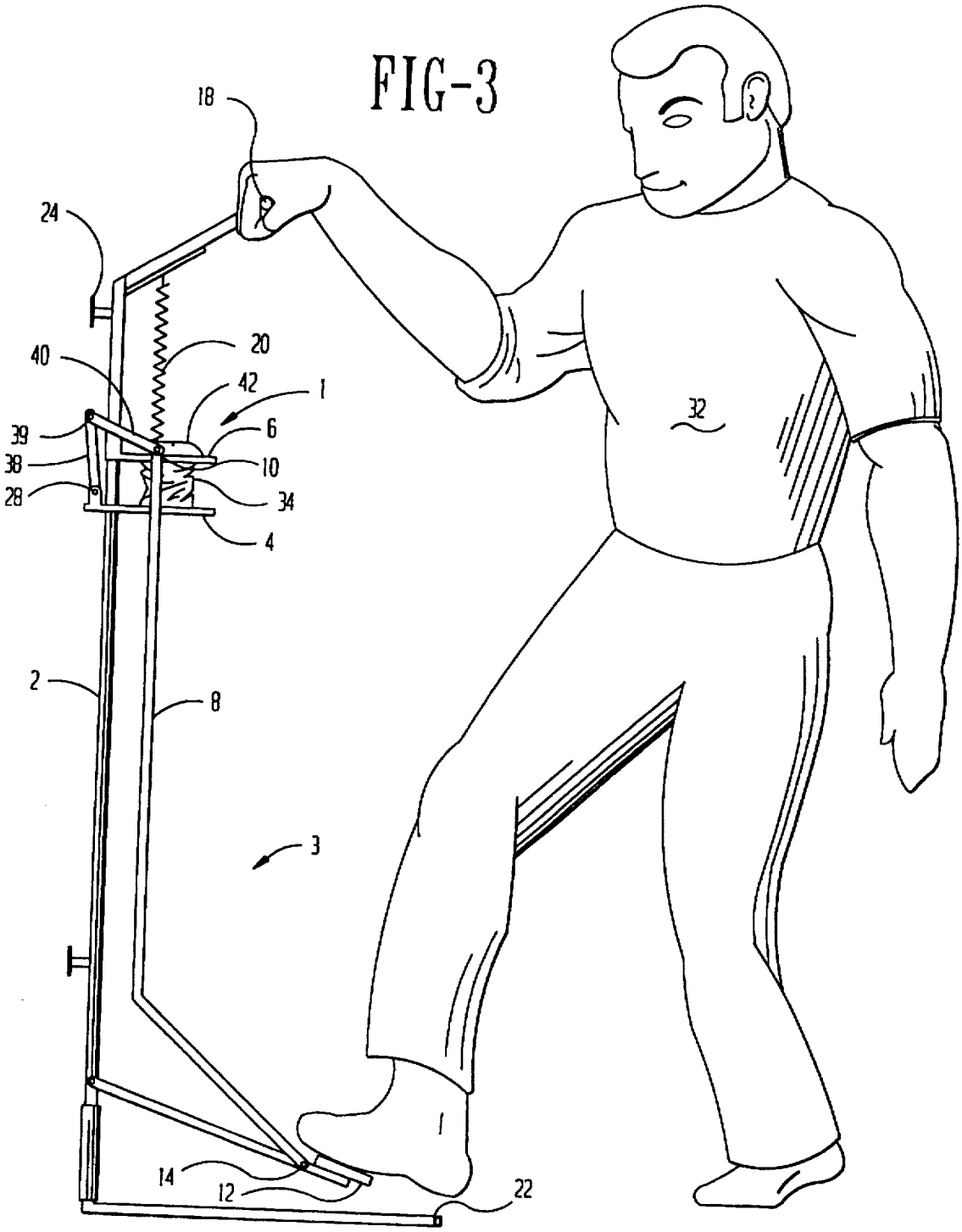
FIG. 3 is a side elevational view halfway down of the crusher with man.

FIG. 3 depicts an operator 32 operating the device by pushing the pedal 12 downward. The downward motion of pedal 12, rotating about the foot pedal-spine pivot 16, tensions tension member 8 thereby moving ram 6 toward the anvil 4 crushing a beverage can 34. Once the beverage can 34 is crushed, the operator 32 removes his foot and the tensioned spring 20 operates to move the ram 6 to the at rest position shown in the side elevation of FIG. 2.

Figure 4:
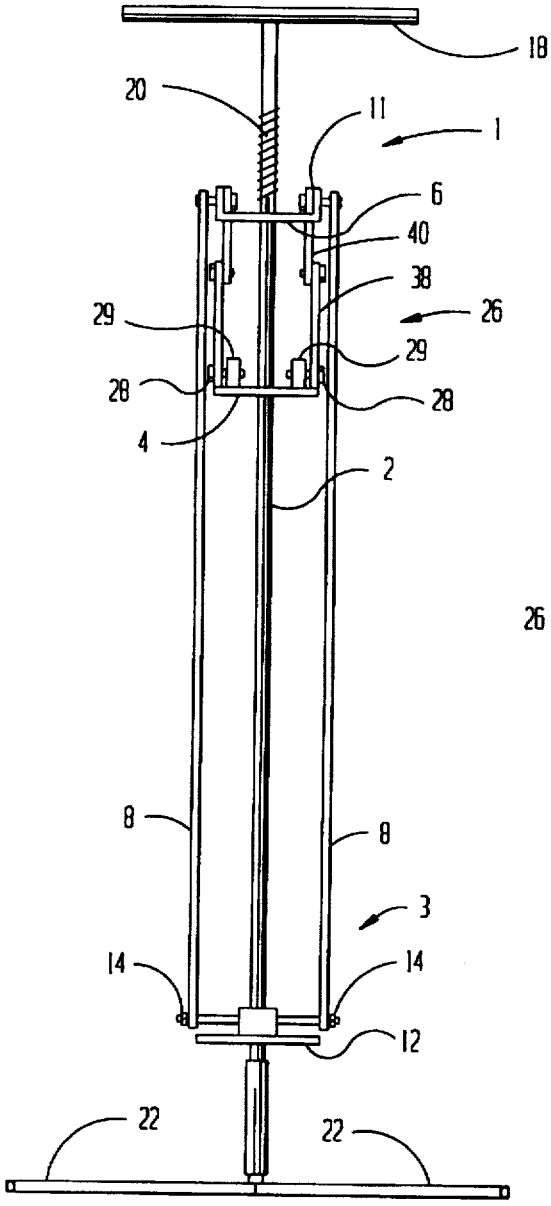
FIG. 4 is a front elevational view of the crusher.

FIG. 4 shows the special relationship between the tension member 8 and the guides 26 at the ram pivot connections 10.

As may be seen the guides 26 prevent the tube 36 from binding on the spine 2 as it moves along the spine. Also the tension member 8 connects to the ram 6 at the pivot 10 which is inline with spring 20; which is also the pivot for the guides 26.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. The structure of a beverage can crusher including a stationary crushing anvil and a movable ram, in combination with above, said improvement comprises:

a) a spine with the crushing anvil and the movable ram mounted on a frontal section thereof, b) a support means on said spine for supporting the spine in an upright position, c) a foot pedal pivoted on a lower portion of the spine, d) a tension member pivoted to said foot pedal and pivoted to said ram, e) said ram attached to a square tube telescoped around an upper portion of the spine such that movement of the ram is in parallel longitudinal relation to the spine, f) a tensioned spring interconnecting the ram and spine for moving said ram to a rest position, g) a handle attached to the top of said spine extending in a direction of the frontal section, h) two legs extending perpendicularly from the lower portion of the spine, said legs extending at a ninety degrees to each other.

2. The structure as defined in claim 1 further comprising:

j) said support means also including at least one bracket rigidly connected to the spine forming a means for connecting the spine to a vertical support.

3. The structure as defined in claim 2 further comprising:

k) a pair of first links pivoted to the ram at the same point as the tension member, and l) a pair of second links, each of said second links pivoted on one end to one each of said first links, m) each of said second links pivoted on a second end to the anvil.

* * * * *